US007262558B2

(12) United States Patent
Hsu

(10) Patent No.: US 7,262,558 B2
(45) Date of Patent: Aug. 28, 2007

(54) LAMP CURRENT CONTROL DEVICE

(75) Inventor: Cheng-Chia Hsu, Chupei (TW)

(73) Assignee: Logah Technology Corp., Hsinchu (TW)

( * ) Notice: Subject to any disclaimer, the term of this patent is extended or adjusted under 35 U.S.C. 154(b) by 170 days.

(21) Appl. No.: 11/225,066

(22) Filed: Sep. 14, 2005

(65) Prior Publication Data

US 2006/0097656 A1 May 11, 2006

(30) Foreign Application Priority Data

Nov. 10, 2004 (TW) ..... 93217929 U

(51) Int. Cl.
*H05B 41/16* (2006.01)

(52) U.S. Cl. ..... 315/256; 315/274; 315/291; 315/307; 315/312

(58) Field of Classification Search ..... 315/246–248, 315/209 R, 224, 225, 291, 307, 308, 297, 315/274–287, 254–256
See application file for complete search history.

(56) References Cited

U.S. PATENT DOCUMENTS 4,328,537 A * 5/1982 Schmidtner et al. ..... 363/21.09
5,418,709 A * 5/1995 Lukemire ..... 323/222

* cited by examiner

*Primary Examiner*—Tuyet Thi Vo

(57) ABSTRACT

A lamp current control device includes an electronic power switch, a transformer, a current transformer and a pulse width modulation (PWM) IC. The transformer has its primary side connected to the electronic power switch and a secondary side connected to a lamp. The current transformer is serially connected with the primary side of the transformer. The PWM IC is coupled between a secondary side of the current transformer and the electronic power switch and uses the current transformer to feedback a feed back signal from the primary side of the transformer. The PWM IC receives and processes the feed back signal to obtain a control signal, and then the PWM IC outputs the control signal to the electronic power switch to control a pulse width outputted by the electronic power switch, thereby controlling and maintaining a brightness of the lamp.

4 Claims, 3 Drawing Sheets

LAMP CURRENT CONTROL DEVICE

BACKGROUND OF THE INVENTION

1. Field of the Invention

The present invention relates to a lamp current control device, and more particularly, to a lamp current control device which is suitable for LCD backlight.

2. Description of the Prior Art

FIG. 1 shows a structure of a conventional single lamp control circuit. In the single lamp control circuit, a transformer 11 has a primary side connected to an electronic power switch 12 and a secondary side of transformer 11 connected with one end of a lamp 13. The other end of lamp 13 is connected to one end of a pulse width modulation (PWM) IC 14, and then the other end of PWM IC 14 is connected to the electronic power switch 12 to form a single lamp control circuit 1. PWM IC 14 detects and processes a feed back current signal to obtain a control signal, and outputs the control signal to the electronic power switch 12 to control a pulse width outputted by the electronic power switch 12, thereby controlling and maintaining a uniform brightness of the lamp 13. However, the above-mentioned circuit is only suitable for controlling single lamp circuit. In the case of controlling multiple lamps, the number of transformers has to be increased proportionally, thus increasing the manufacturing cost and limiting the use of the single lamp control circuit.

FIG. 2 illustrates a structure of a conventional double lamps control circuit. In the double lamps control circuit, a transformer 21 has a primary side connected to an electronic power switch 22 and a secondary side of transformer 21 connected with one end of each one of two lamps 23. The other end of each lamp 23 is connected to one end of PWM IC 24, and then the other end of PWM IC 24 is connected to the electronic power switch 22 to form a double lamps control circuit 2. PWM IC 24 detects and processes a feed back current signal to obtain a control signal, and outputs the control signal to the electronic power switch 22 to control a pulse width outputted by the electronic power switch 22, thereby controlling and maintaining a uniform brightness of each lamp 23. However, the above-mentioned circuit is only suitable for controlling double lamps circuit. In the case of controlling multiple lamps, the number of transformers has to be increased proportionally, and the number of the feedback circuit has to be increased as well, thus increasing the manufacturing cost and limiting the use of the double lamps control circuit.

FIG. 3 illustrates a structure of a conventional long lamp control circuit. In the long lamp control circuit, each one of the two transformers 31 has a primary side connected to an electronic power switch 32 and a secondary side with one end connected to one end of a lamp 33. The other end of the secondary side of each transformer 31 is connected to one end of PWM IC 34, and then the other end of PWM IC 34 is connected to the electronic power switch 32 to form a long lamp control circuit 3. PWM IC 34 detects and processes a feed back current signal to obtain a control signal, and outputs the control signal to the electronic power switch 32 to control a pulse width outputted by the electronic power switch 32, thereby controlling and maintaining a uniform brightness of long lamp 33. However, the above mentioned circuit is only suitable for controlling long lamp circuit, besides, it is necessary to use two transformers for one long lamp. In the case of controlling multiple lamps, the number of transformers has to be increased proportionally, and the number of the feedback circuit has to be increased as well, thus increasing the manufacturing cost and limiting the use of the long lamp control circuit.

Therefore, the convention lamp current control devices mentioned above present several shortcomings to be overcome.

In view of the above-described deficiency of conventional transformers, after years of constant effort in research, the inventor of this invention has consequently developed and proposed a lamp current control device in the present invention.

SUMMARY OF THE INVENTION

The present invention is to provide a lamp current control device which is suitable for controlling single lamp, double lamps, multiple lamps and long lamps.

Another, the present invention is to provide a lamp current control device which improves product stability, extends product lifetime, reduces cost, reduces transformer size and saves space for installment.

A lamp current control device of the present invention comprises an electronic power switch, a transformer, a current transformer and a pulse width modulation (PWM) IC. The transformer has a primary side connected to the electronic power switch and a secondary side connected to a lamp. The current transformer is serially connected with the primary side of the transformer. The PWM IC is coupled between a secondary side of the current transformer and the electronic power switch and uses the current transformer to feedback a feed back signal from the primary side of the transformer. The PWM IC receives and processes the feed back signal to obtain a control signal, and then the PWM IC outputs the control signal to the electronic power switch to control a pulse width outputted by the electronic power switch, thereby controlling and maintaining a brightness of the lamp.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
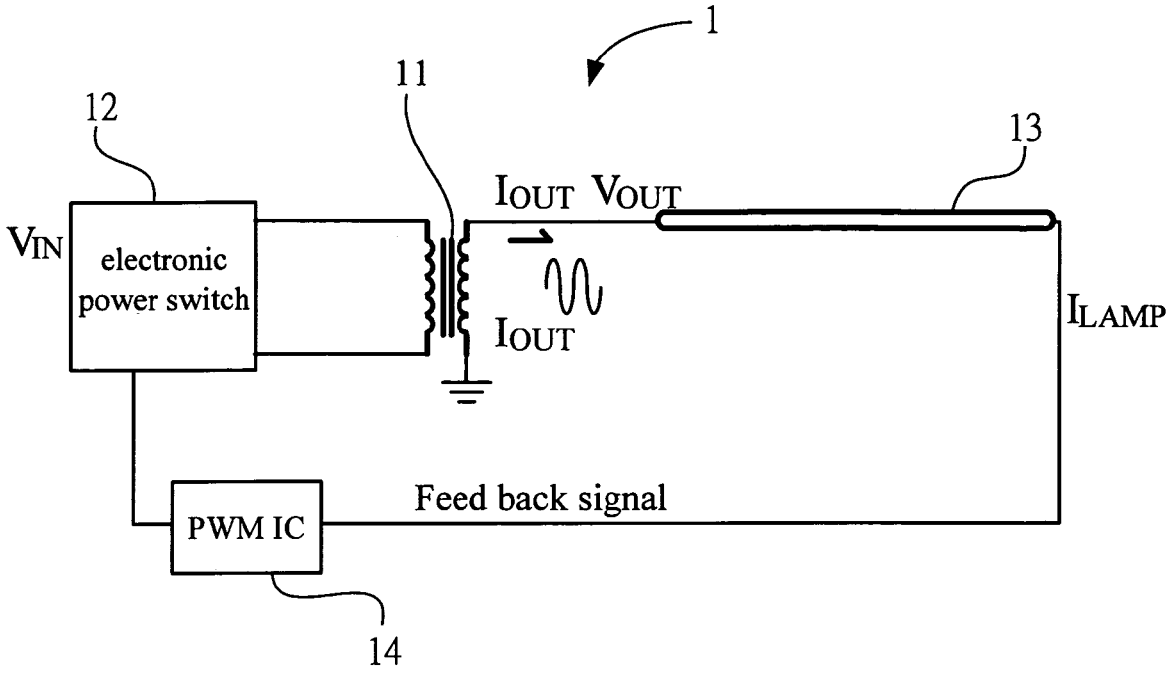
FIG.1 (PRIOR ART)
FIG. 1 illustrates a structure of a conventional single lamp control circuit.
Figure 2:
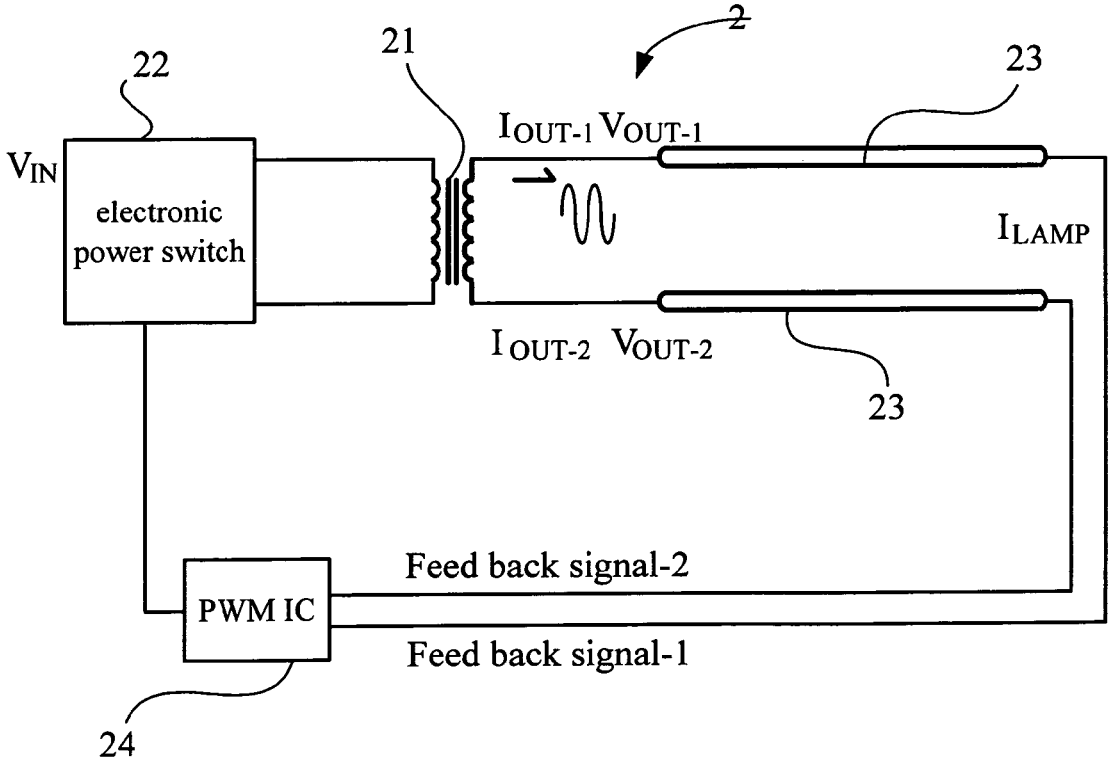
FIG.2 (PRIOR ART)
FIG. 2 illustrates a structure of a conventional double lamps control circuit.
Figure 3:
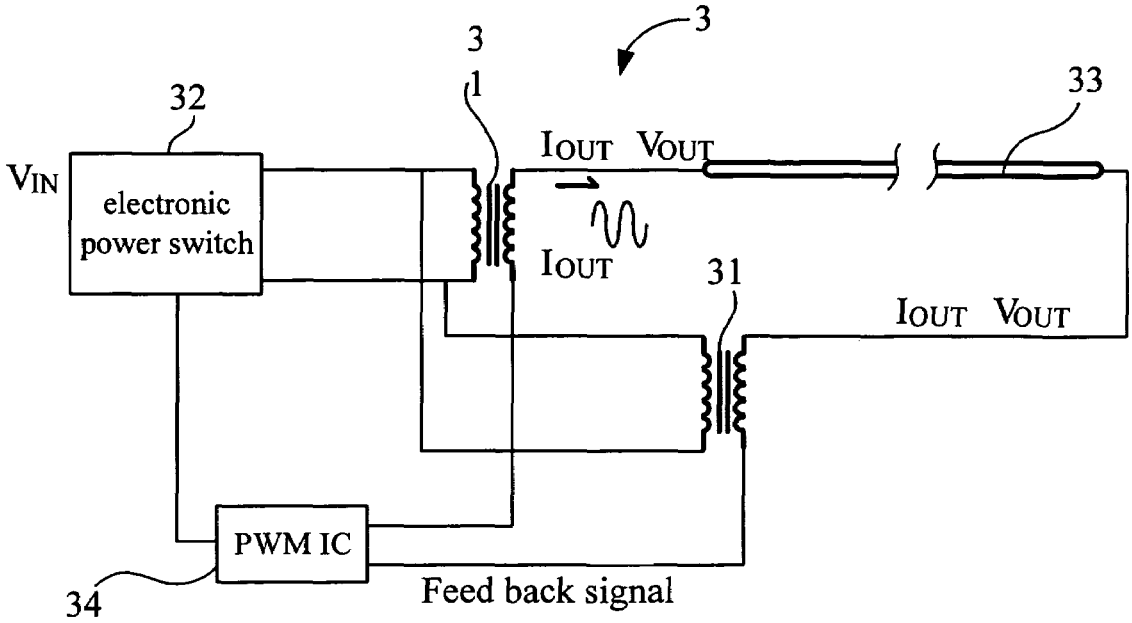
FIG.3 (PRIOR ART)
FIG. 3 illustrates a structure of a conventional long lamp control circuit.
Figure 4:
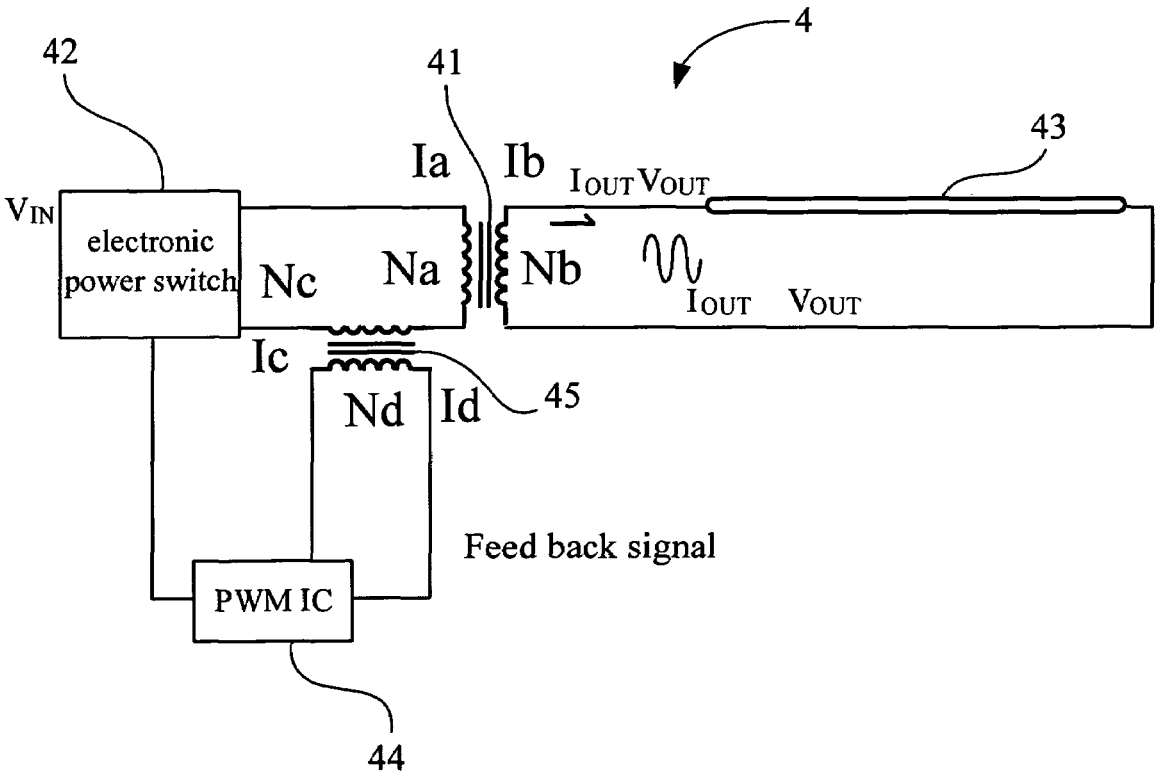
FIG. 4 illustrates an implementation of a lamp current control device in the present invention when applied in a single lamp circuit.

FIG. 4 illustrates an implementation of a lamp current control device in the present invention when applied in a single lamp circuit. In this figure, a lamp current control device 4 in the present invention comprises an electronic power switch 42, a transformer 41, a current transformer 45 and a pulse width modulation (PWM) IC 44. The transformer 41 has a primary side connected to the electronic power switch 42 and a secondary side connected to a lamp 43 (which can be a long lamp). The current transformer 45 is connected with the primary side of transformer 41 in serial. PWM IC 44 is coupled between a secondary side of the current transformer 45 and the electronic power switch 42. For Na*Ia=Nb*Ib, Nc*Ic=Nd*Id, Ic=Ia,=>Id=(NcNb/NdNa)*Ib, thus use the current transformer 45 to feedback an feed back signal from the primary side of transformer 41. PWM IC 44 receives and processes the feed back signal to obtain a control signal, then PWM IC 44 outputs the control signal to the electronic power switch 42 to control a pulse width outputted by the electronic power switch 42, thereby controlling and maintaining a uniform brightness of lamp 43.

Figure 5:
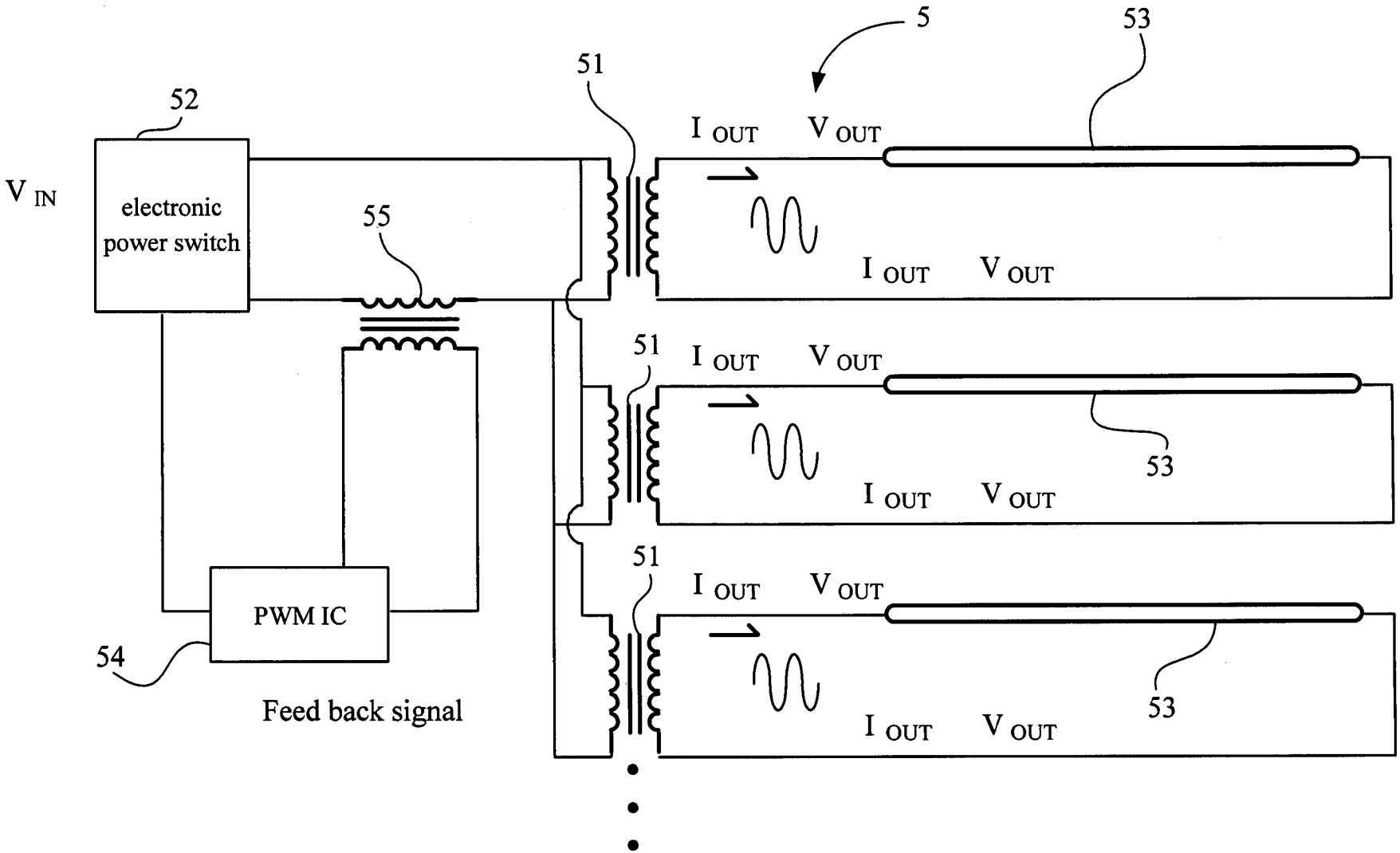
FIG. 5 illustrates an implementation of a lamp current control device in the present invention when applied in a multiple lamps circuit.

FIG. 5 illustrates an implementation of a lamp current control device in the present invention when applied in a multiple lamps circuit. In this figure, a lamp current control device 5 comprises an electronic power switch 52, a plurality of transformers 51, a current transformer 55 and a PWM IC 54. Each one of the plurality of transformers 51 has a primary side connected to the electronic power switch 52 in a shunt configuration and a secondary side connected to a lamp 53 (which can be a long lamp). The current transformer 55 is connected with the primary side of each one of the plurality of transformers 51 in serial. PWM IC 54 is coupled between a secondary side of current transformer 55 and the electronic power switch 52 and uses the current transformer 55 to feedback a feed back signal collected from the primary side of each one of the plurality of transformers 51. PWM IC 54 receives and processes the feed back signal to obtain a control signal, and then PWM IC 54 outputs the control signal to the electronic power switch 52 to control a pulse width outputted by electronic power switch 52, thereby controlling and maintaining a uniform brightness of lamp 53.

The present invention provides a lamp current control device, which compared with other prior lamp current control devices, has advantageous as follows.

The present invention provides a lamp current control device, which is suitable for controlling single lamp, double lamps, multiple lamps and long lamp.

The present invention provides a lamp current control device, which improves product stability, extends product lifetime, reduces cost, reduces transformer size and saves space for installment.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A lamp current control device comprising:

a lamp;

an electronic power switch;

a transformer with a primary side connected to said electronic power switch and a secondary side connected to said lamp;

a current transformer connected with the primary side of said transformer in serial; and a pulse width modulation integrated circuit (PWM IC) coupled between a secondary side of said current transformer and said electronic power switch and using said current transformer to feedback an feed back signal from the primary side of said transformer, said PWM IC receiving and processing said feed back signal to obtain a control signal, then said PWM IC outputting said control signal to said electronic power switch to control a pulse width outputted by said electronic power switch, thereby controlling and maintaining a uniform brightness of said lamp.

2. The lamp current control device of claim 1 wherein said lamp is a long lamp.

3. A lamp current control device comprising a plurality of lamps, an electronic power switch, a plurality of transformers, a current transformer and a Pulse Width Modulation (PWM) IC; each one of said plurality of transformers having a primary side connected to said electronic power switch in a shunt configuration and a secondary side connected to a coresponding lamp respectively, said lamp current control device is characterized in: said current transformer connected with the primary side of each one of said plurality of transformers in serial, said PWM IC being coupled between a secondary side of said current transformer and said electronic power switch and using said current transformer to feedback an feed back signal collected from the primary side of each one of said plurality of transformers, said PWM IC receiving and processing said feed back signal to obtain a control signal, then said PWM IC outputting said control signal to said electronic power switch to control a pulse width outputted by said electronic power switch, thereby controlling and maintaining a uniform brightness of said lamps.

4. The lamp current control device of claim 3 wherein said plurality of lamps are long lamps.

* * * * *